US007661148B2

(12) United States Patent
Landi et al.

(10) Patent No.: US 7,661,148 B2
(45) Date of Patent: Feb. 16, 2010

(54) HUMAN LIMB/JOINT PROTECTIVE PAD AND METHOD OF MAKING

(75) Inventors: James J. Landi, West Orange, NJ (US); Michael Landi, Glen Ridge, NJ (US)

(73) Assignee: XO Athletic, Co., Union, NJ (US)

( * ) Notice: Subject to any disclaimer, the term of this patent is extended or adjusted under 35 U.S.C. 154(b) by 1232 days.

(21) Appl. No.: 10/645,191

(22) Filed: Aug. 21, 2003

(65) Prior Publication Data

US 2005/0039245 A1 Feb. 24, 2005

(51) Int. Cl.
*A41D 13/00* (2006.01)

(52) U.S. Cl. ..... 2/24; 2/16

(58) Field of Classification Search ..... 2/24, 2/16, 22, 455, 911, 908, DIG. 3; 128/878, 128/881, 882; 602/23, 26, 62
See application file for complete search history.

(56) References Cited

U.S. PATENT DOCUMENTS

| | | | |
|---|---|---|---|
| 487,492 | A | 12/1892 | Pugsley |
| 607,243 | A | 7/1898 | Huff |
| 4,484,361 | A | 11/1984 | Leighton et al. |
| 4,494,247 | A | 1/1985 | Kelly |
| 4,513,449 | A | 4/1985 | Donzis |
| 4,921,671 | A | 5/1990 | Staheli |
| 4,988,282 | A | 1/1991 | Fukui |
| 5,011,394 | A | 4/1991 | Katagiri et al. |
| 5,449,483 | A | 9/1995 | Greenwood et al. |
| 5,451,201 | A | 9/1995 | Prengler |
| 5,472,413 | A | 12/1995 | Detty |
| 5,622,667 | A | 4/1997 | Fujiyama et al. |
| 5,629,029 | A | 5/1997 | Souder et al. |
| 5,792,407 | A | 8/1998 | Berzack |
| 6,029,273 | A | 2/2000 | McCrane |
| 6,033,611 | A | 3/2000 | Yamaguchi |
| 6,098,209 | A | 8/2000 | Bainbridge et al. |
| 6,146,122 | A | 11/2000 | Kato |
| 6,151,714 | A | 11/2000 | Pratt |
| 6,156,000 | A | 12/2000 | Chen et al. |
| 6,253,376 | B1 | 7/2001 | Ritter |
| 6,270,332 | B1 | 8/2001 | Huggins et al. |
| 6,319,219 | B1 | 11/2001 | Landi |
| 6,319,451 | B1 | 11/2001 | Brune |
| 6,342,176 | B2 | 1/2002 | Goto et al. |
| 6,347,403 | B1 | 2/2002 | Wilcox |
| 6,401,245 | B1 | 6/2002 | Slautterback |
| 6,421,839 | B1 | 7/2002 | Vo et al. |

*Primary Examiner*—Tejash Patel
(74) *Attorney, Agent, or Firm*—Lerner, David, Littenberg, Krumholz & Mentlik, LLP

(57) ABSTRACT

A protective pad includes a pre-tensioned resilient padded membrane resiliently suspended to a semi-rigid shell. A cavity is defined between the pre-tensioned padded membrane and the shell. In use, the pad is attached to the limb or joint to be protected with the tensioned membrane engaging the limb or joint to be protected. The pre-tensioned membrane and air cushion in the cavity absorb the energy of an impact transferred by the shell during a sporting event or other activity.

20 Claims, 10 Drawing Sheets

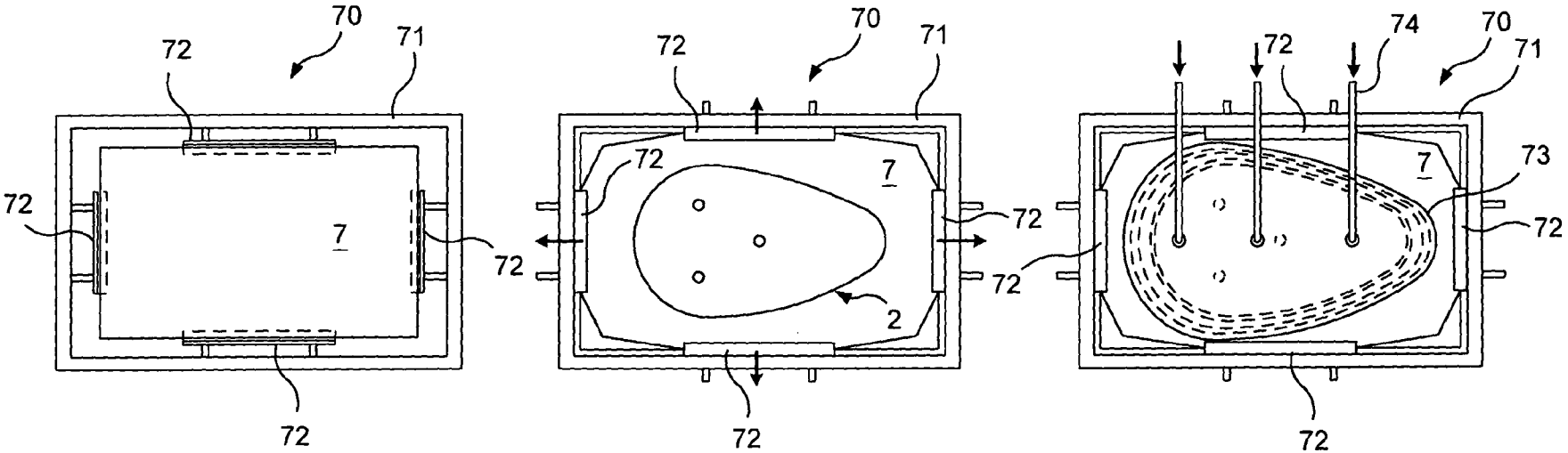
FIG. 8A
FIG. 8B
FIG. 8C
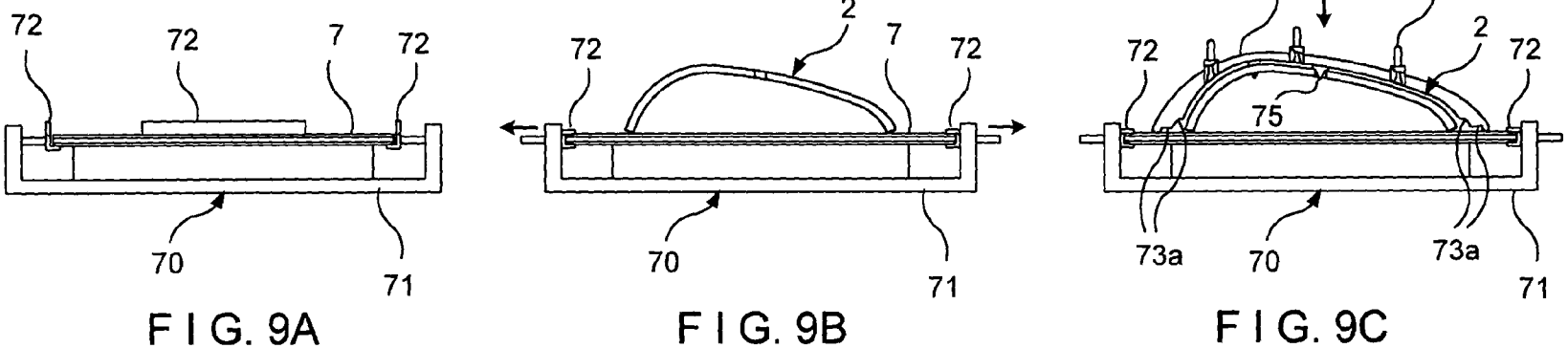
FIG. 9A
FIG. 9B
FIG. 9C

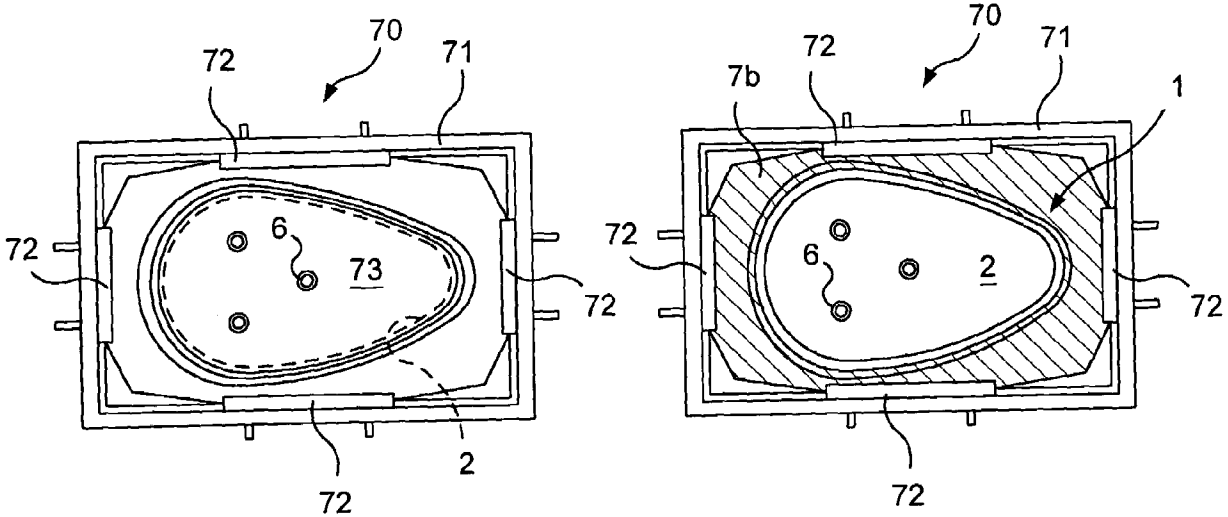
FIG. 8D
FIG. 8E
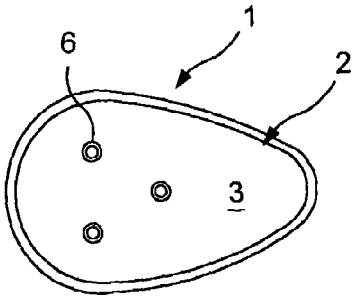
FIG. 8F
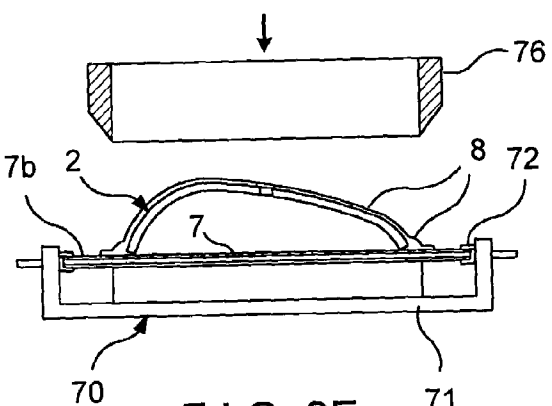
FIG. 9D
FIG. 9E
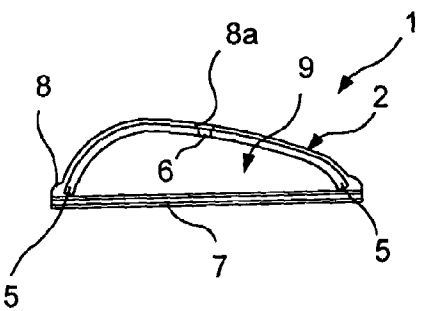
FIG. 9F

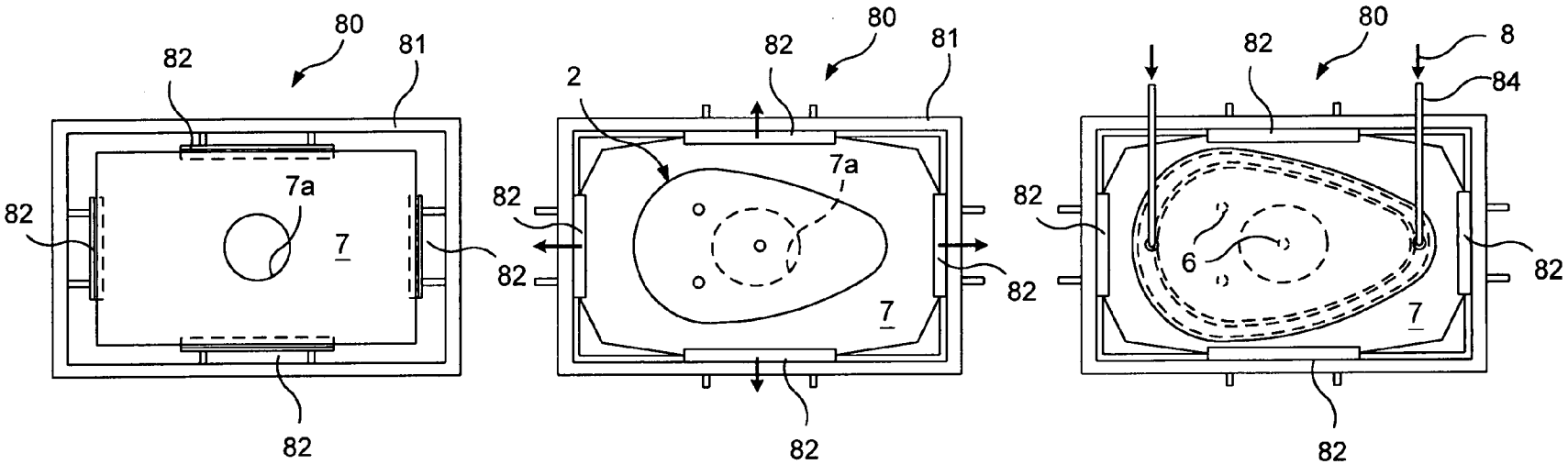
FIG. 10A
FIG. 10B
FIG. 10C
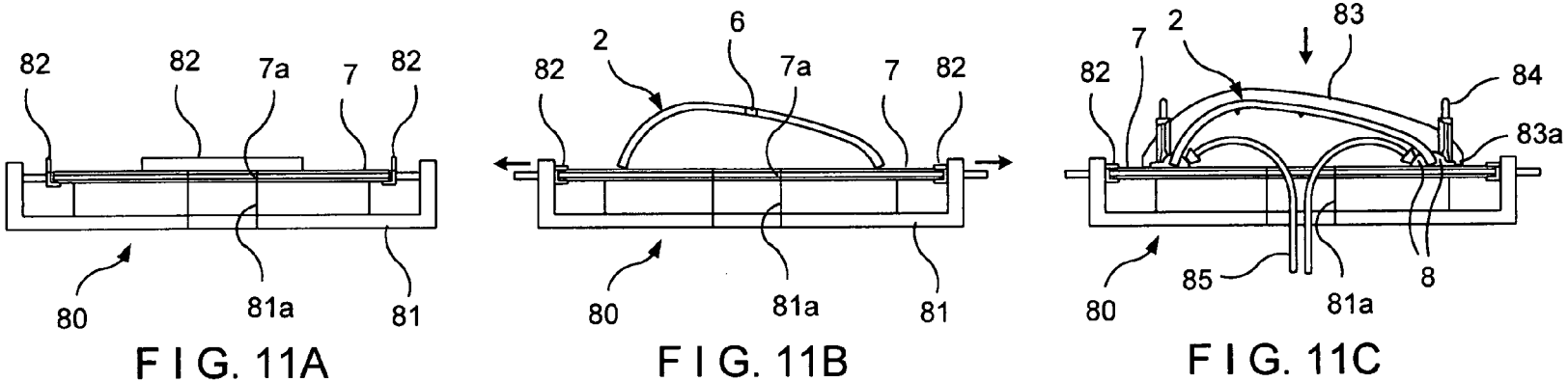
FIG. 11A
FIG. 11B
FIG. 11C

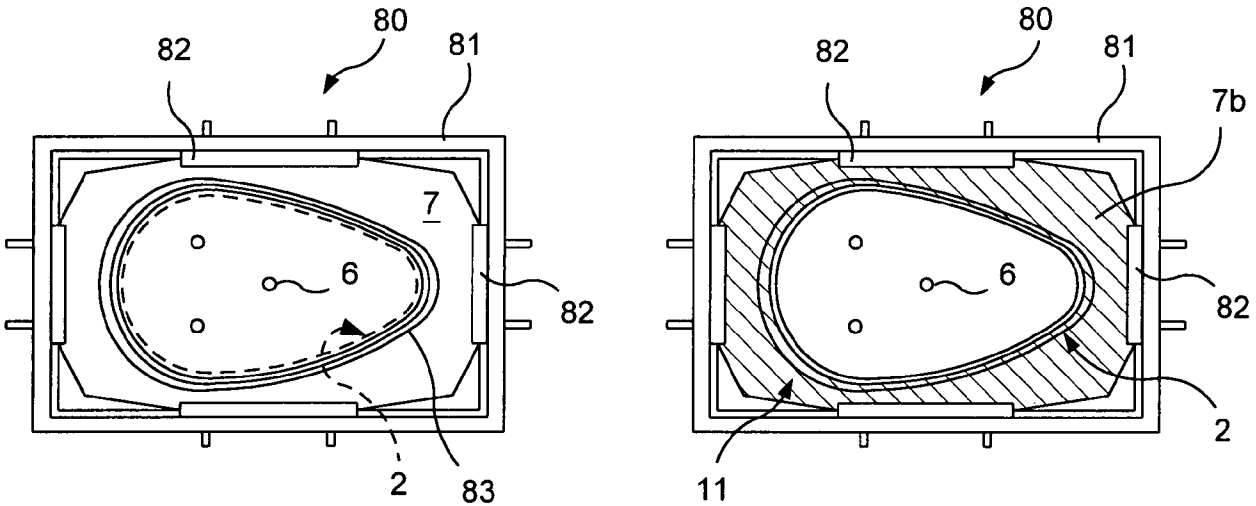
FIG. 10D
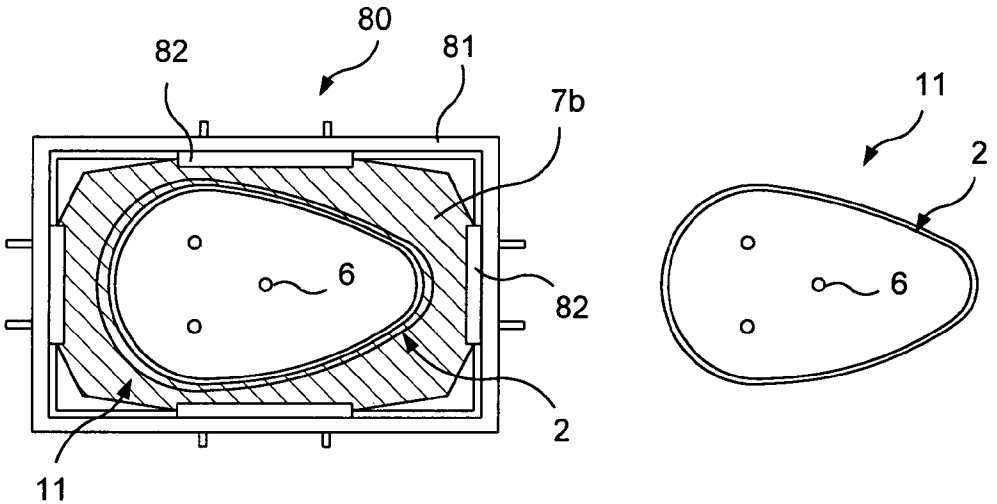
FIG. 10E
FIG. 10F
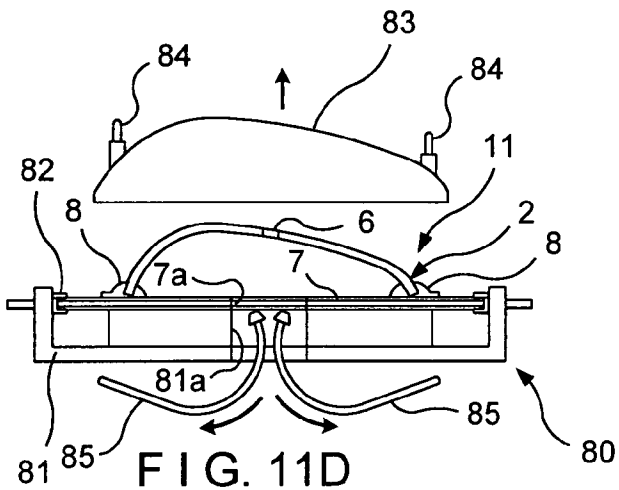
FIG. 11D
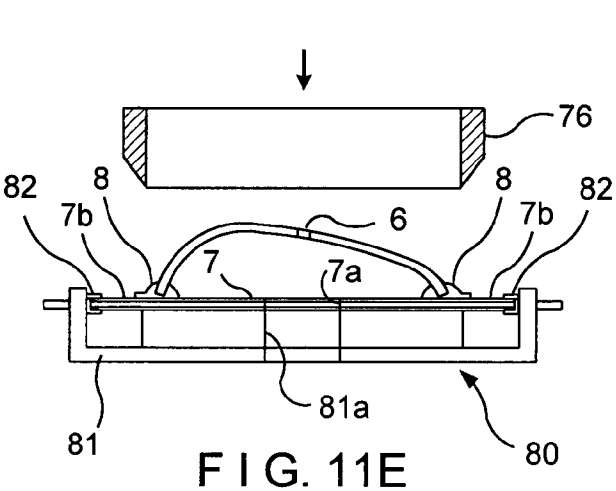
FIG. 11E
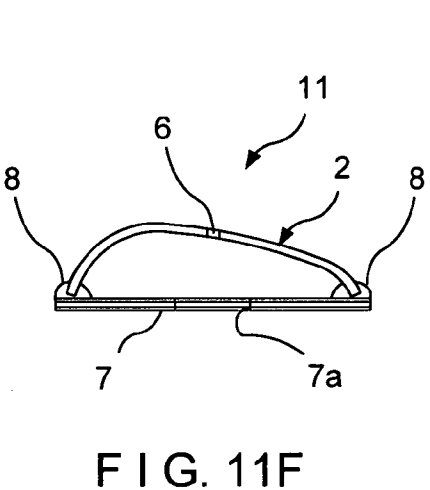
FIG. 11F

HUMAN LIMB/JOINT PROTECTIVE PAD AND METHOD OF MAKING

FIELD OF THE INVENTION

The invention relates generally to pads for protecting the limbs and joints of humans. More particularly, the invention relates to protective pads having a tensioned padded membrane bonded to a semi-rigid shell to impart a resilient, trampoline-like dampening effect.

DESCRIPTION OF THE PRIOR ART

Protective equipment such as, for example, shoulder pads, rib protectors, hip pads and thigh pads are commonly worn by participants in many types of sporting events for protection from shock resulting from contact with an object or another participant. Such protective equipment has long been used by athletes in such contact sports as football and hockey, as well as non-contact sports such as baseball, basketball, equestrian events, and so forth. Protective pads such as knee and elbow pads are commonly used during activities such as, for example, skating, skateboarding, and cycling to protect against bodily injury during falls on pavement or other hard surfaces.

Conventional protective pads typically include a relatively hard outer shell of a material such as plastic, leather, vulcanized fiber, and the like, as well as an inner layer of soft padding material. The hard outer layer is provided to receive the applied force or shock of an impact, and to distribute the force over a large area. The soft padding material, in addition to acting as a cushion for providing comfort to the wearer, usually acts to absorb and dampen the aforementioned force in order to protect the wearer from the shock of an impact. Some exemplary conventional padding materials include cotton, foam rubber, foamed plastic, sponge rubber, and expanded rubber or vinyl. Such designs rely heavily upon the softness and resulted resilience of the padding material to absorb the applied force.

A common protective pad construction often provides a substantial thickness of cushioning material attached to an interior surface of a protective shell. In this manner the thickness of cushioning material fills a substantial portion or the entire gap or space between the shell and a limb or joint intended to be protected. U.S. Pat. Nos. 6,401,245 and 6,156,000 are exemplary of this common type of protective pad construction. The '245 patent discloses a knee cup 10 sewn to a cushioning base 29 directly engaging the knee of a wearer. The knee cup includes an outer shell 12 having a rear indentation 32 completely filled with a dampening insert 14, such that the insert is interposed between the shell and the base. One drawback of this prior art protective pad is that it has a relatively complex construction requiring several time-consuming and labor-intensive fabrication steps. Another drawback of this type of construction is that the stitching used to attach the knee cup 10 to the cushioning base 29 results in the transfer of impact forces to relatively minute concentrated areas along the edge of the base 29. In fact, it is not uncommon for the concentrated forces applied along relatively small stitched areas to exceed the tensile strength of the fabric base 29 at these areas of attachment. As a result, repetitive impacts can lead to accelerated tearing or ripping of the fabric, and corresponding premature separation of the base fabric from the protective shell or cup. Generally, protective pad constructions utilizing unyielding, non-resilient attachment means, such as stitches, rivets, glues and the like, have relatively limited durability. The U.S. Pat. No. 6,156,000 discloses a method for making a protective pad wherein a blank pad 11 is cut into a shaped pad 11' and a rigid shield is formed directly on the exterior surface of the shaped pad by injection molding a material such as polyvinyl chloride. The 6,156,000 discloses a substantially simplified method of construction. However, the direct bonding of the rigid shield to the pad, without any resilient intermediate layer, results in the same susceptibility of the article to tearing and separation between the shield and the pad. Furthermore, in pad constructions where the cushioning material completely fills the gap or space between the shell and the body part or joint being protected, the degree of cushioning or dampening of an impact force is substantially limited by the resiliency and thickness of the cushioning layer.

U.S. Pat. No. 6,151,714 discloses another type of protective pad 10 having a construction wherein a rigid outer shell 24 having a shielding element 12 is attached along a peripheral shell flange 28 to an underlying planar cushioning body 16 such that a cavity 40 is formed between the shell and cushioning body. The protective pad disclosed in the '714 patent offers some improvement with regard to impact force dampening. Particularly, upon application of a force to the impact surface 30 of the shell 24, the shielding element 12 resists flexing as the cushioning element 14 flexes to permit penetration of the protected joint surface 20 into the cavity. However, the peripheral shell flange is stitched to the planar cushioning body and, therefore, suffers from the aforementioned susceptibility to tearing and separation due to concentrated forces at these localized attachment areas.

U.S. Pat. Nos. 5,451,201; 4,484,361; 4,494,247; 4,513,449; 5,472,413; 6,029,273; 6,098,209; 6,253,376; 6,319,219; 6,347,403 and 6,421,839 disclose examples of other protective device constructions which suffer from one or more of the aforementioned drawbacks and limitations of the prior art.

Accordingly, there is a well-established need for a protective pad having a construction overcoming the drawbacks and limitations of the prior art. In particular, it would be desirable to provide a protective pad having improved dampening characteristics and enhanced durability. Furthermore, the protective pad should be comfortable to wear and have a relatively simple construction lending itself to efficient, cost-effective and non labor-intensive manufacturing.

SUMMARY OF THE INVENTION

The invention is directed to protective pads for protecting the elbows, knees, shoulders or other joints or limbs or the genital area or breasts of a person during a sporting event or other activity. The protective pads are comfortable to wear and have a construction providing a trampoline-like resilient quality that enhances the protective capability of the pads in the event that the wearer is struck in the region in which the pad is worn. An efficient, cost-effective and non labor-intensive method is provided for making the protective pads.

In one general aspect of the present invention, a protective pad is provided comprising:

a shell having a concave interior surface and a convex outer surface adjoined by a perimeter edge; a pre-tensioned resilient padded membrane; and an elastic suspension arrangement adjoining the pre-tensioned resilient padded membrane about the perimeter edge of said shell to define a cavity between the shell and the tensioned resilient padded membrane.

In a further aspect of the present invention, a central aperture may be provided extending through the tensioned resilient padded membrane for engaging the joint being protected.

In another aspect of the present invention, the edge of the shell may be formed to define a flanged region attached to the pre-tensioned padded membrane with a resilient bonding material.

In a still further aspect of the present invention, the resilient bonding material may extend to or substantially cover the entire exterior surface of the tensioned padded membrane.

In another aspect of the present invention, the resilient bonding material may extend to or substantially cover the entire exterior surface of the shell.

In yet a further aspect of the present invention, the protective pad defines an elbow pad.

Still another aspect of the present invention provides a helmet.

Yet another aspect of the present invention provides a shoulder pad.

A still further aspect of the present invention provides a protective pad for protecting the genitals or breasts.

In a still further aspect of the present invention, a method of fabricating a protective pad is provided wherein a resilient padded membrane is stretched into a tensioned configuration, a shell is brought into engagement with the tensioned padded membrane, and a resilient bonding material is introduced between the edge of the shell and the tensioned padded membrane so as to form an elastic suspension arrangement therebetween.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 8A is a top view of an injection-molding apparatus, illustrating the positioning of a padded membrane in the mold in a first step for fabricating a protective pad in accordance with the present invention;

FIG. 8B is a top view of the injection mold of FIG. 8A, showing stretching of the padded membrane in multiple directions into a tensioned state or configuration, and subsequent positioning of the shell in an open injection mold in a second fabrication step;

FIG. 8C is a top view of the injection-molding apparatus, showing a bonding material mold positioned over the shell, and the subsequent injection molding of an elastic bonding material between the shell and the tensioned padded membrane along the outer surface of the shell in a third fabrication step;

FIG. 8D is a top view of the injection mold, showing lifting of the bonding mold from the shell on the injection mold;

FIG. 8E is a top view of the injection mold, showing cutting or excising of excess padded membrane material from the shell;

FIG. 8F is a top view of the protective joint pad of FIG. 1, fabricated using the steps of FIGS. 8A-8E;

FIGS. 9A-9C are longitudinal sectional views of FIG. 8A-8C, respectively;

FIG. 9D is a longitudinal sectional view of FIG. 8D, with the bonding mold shown in side view;

FIGS. 9E-9F are longitudinal sectional views of FIGS. 8E-8F, respectively;

FIG. 10A is a top view of an injection mold, illustrating positioning of the padded membrane in the mold in a first step for fabricating a second embodiment of the protective pad in accordance with the present invention;

FIG. 10B is a top view of the injection mold of FIG. 10A, showing stretching of the padded membrane in multiple directions and positioning of the shell in the injection mold in a second fabrication step;

FIG. 10C is a top view of the injection mold, showing a bonding mold positioned over the shell and injection-molding of the bonding material between the shell and the padded membrane material in a third fabrication step;

FIG. 10D is a top view of the injection mold, showing lifting of the bonding mold from the shell on the injection mold;

FIG. 10E is a top view of the injection mold, showing cutting of excess padded membrane material from the shell;

FIG. 10F is a top view of the protective joint pad of FIG. 3, fabricated using the steps of FIGS. 10A-10E;

FIGS. 11A-11H are longitudinal sectional views of FIGS. 10A-10H respectively;

DETAILED DESCRIPTION OF THE PREFERRED EMBODIMENTS

Shown throughout the figures, the present invention is generally directed to protective pads for human joints or limbs, and methods for making the pads. The pads incorporate a tensioned resilient padding membrane which is connected to a semi-rigid shell by means of an elastic suspension arrangement utilizing an elastic bonding material in order to achieve a trampoline-like quality providing comfort to the wearer, enhanced dampening, and improved durability vis-à-vis existing protective pad designs. The protective pads of the present invention have a simple construction complemented by an efficient, high-speed, cost-effective and non labor-intensive method of production.

Figure 1:
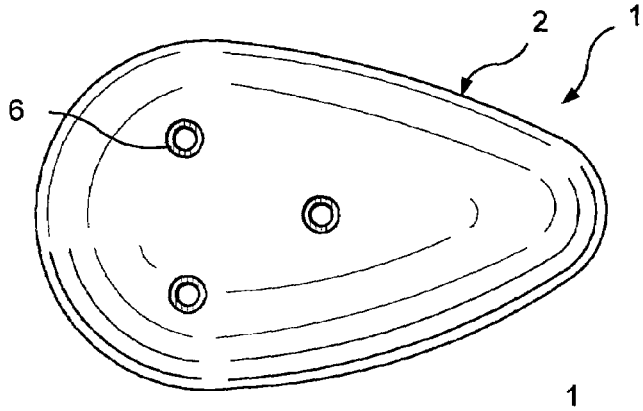
FIG. 1 is a top view of a knee pad embodiment of the protective pads of the present invention.
Figure 2:
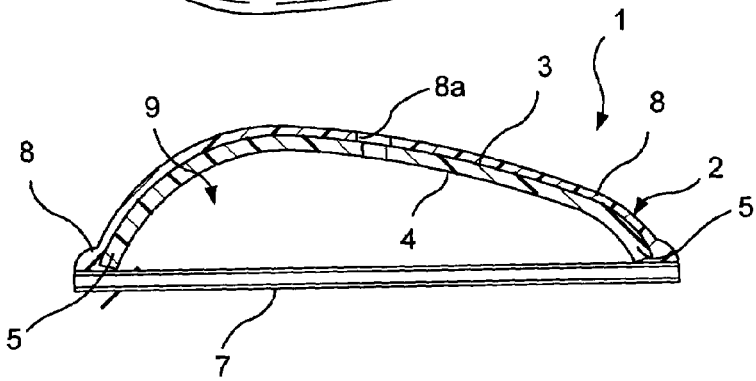
FIG. 2 is a longitudinal cross-sectional view of the protective pad of the invention illustrated in FIG. 1.

Referring initially to FIGS. 1 and 2, in which a first embodiment of the present invention a protective knee pad is generally indicated by reference numeral 1. The protective pad includes a unitary pad body or shell 2, preferably molded or otherwise formed from a rigid or semi-rigid material such as polypropylene or similar thermoplastic resins. The shell 2 has a convex outer surface 3 and a concave inner surface 4 adjoined by a continuous peripheral edge 5. Preferably, one or more vent openings 6 are provided extending through the shell 2. The shell 2 is directly fused about its periphery to a resilient padded membrane, indicated generally by reference numeral 7. This is accomplished through the formation of the elastic suspension arrangement in the form of an elastic or resilient bonding material 8.

Significantly, the resilient padded membrane is stretched into a tensioned state, or configuration, prior to having the shell 2 bonded thereto. The significance of attaching the resilient padded membrane 7 in such a tensioned state will become apparent from the following description. Preferably, padded membrane 7 is fabricated from a synthetic rubber or like material providing the necessary resiliency. By way of example, the applicant has been successful using neoprene, a polymerized chloroprene that, in addition to being resilient, is highly resistant to ozone, weathering, various chemicals, oil and flame. Preferably, the elastic suspension arrangement in the form of resilient or semi-resilient bonding material 8 comprises a soft elastomer, such as kraton and the like, characterized by the ability to stretch under low stress conditions and, upon release of the stress, return with force to its approximate original configuration.

An air-filled space or cavity 9 is defined between the tensioned padded membrane 7 and the concave inner surface 4 of the shell 2. As shown in FIG. 2, in one aspect of the invention the resilient bonding material 8 provided along the periphery of the shell, and generally about an outer area of engagement of the shell and the padded membrane 7, extends completely over the upper convex surface 3 of the shell 2 to provide additional enhanced dampening of the force of an impact to the shell 2. Openings 8*a* are provided through the layer of bonding material 8 in communication with corresponding vent openings 6 in the shell 2. Preferably, the bonding material layer openings 8*a* are slightly larger than the corresponding openings 6 in underlying shell 2.

Figure 3:
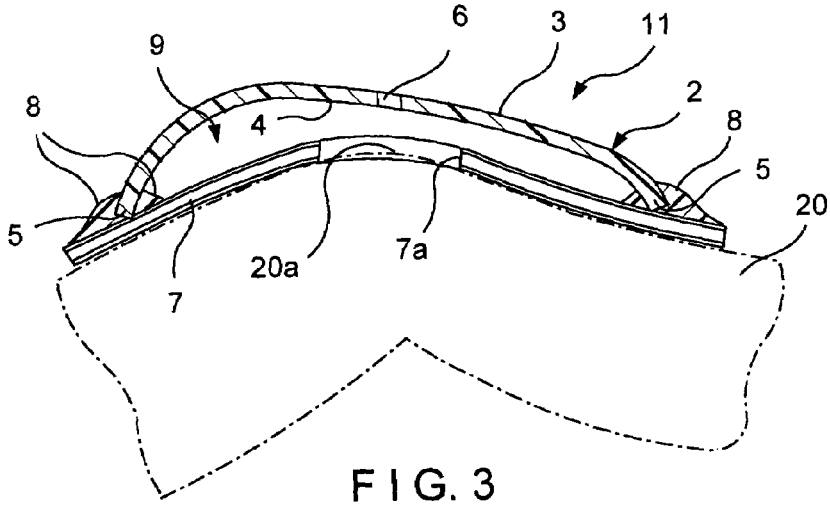
FIG. 3 is a longitudinal cross-sectional view of a knee pad embodiment of the protective pads of the present invention, wherein the knee pad includes a joint-engaging aperture extending through the padded membrane, with the knee pad shown on the knee of a wearer in application of the invention.

Referring now to FIG. 3, in another aspect of the present invention, the protective pad 11 is provided having an aperture 7*a* extending through the tensioned padded membrane 7 in communication with cavity 9. The padded membrane aperture 7*a* is preferably sized and shaped for frictionally engaging and at least partially conforming to the patella, or knee 20*a*, of the leg 20 of a wearer. The padded membrane 7 engages the user's leg 20, and the aperture 7*a* enhances positional stability of the padded membrane 7 on the leg 20. Preferably, the protective pad is held in place by straps (not shown) or other fastening means known by those skilled in the art. As is further illustrated in FIG. 3, the elastic or resilient bonding material 8 can be provided disposed about both inner and outer areas of engagement of the periphery of the shell 2 and the upper surface of the tensioned padded membrane 7.

The construction of the protective pads of the present invention form a unique trampoline-like arrangement that provides significantly enhanced impact protection to the joints or other body parts being shielded vis-à-vis prior art protective pad constructions. Particularly, the tensioned padded membrane 7 is suspended about the periphery of the shell 2 by the elastic suspension arrangement or the elastic or resilient bonding material 8 in a manner similar to that when a resilient sheet is attached by resilient cords or springs to the frame of a trampoline. During the tensioning process, the resilient padded membrane 7 stores kinetic energy that tends to return it to the initial unstressed condition. Accordingly, as best illustrated in FIG. 3, upon application of a force against the exterior shell surface 3, the resilient padded membrane 7 overlying the joint surface 20*a* temporarily stretches or flexes into the cavity 9 such that the impact energy or force against the shell is transferred to, and substantially absorbed by, both the elasticity of the bonding material 8 and the resiliency of the padded membrane 7. Subsequently, the padded membrane 7 returns to its pre-impact tensioned configuration. In this manner, the tensioned pre-stressed padded membrane's resistance to subsequent compression or deformation combined with the elasticity of the bonding material during an impact provides efficient protection to the wearer.

Additional impact energy dampening is achieved as a result of air trapped within the cavity 9. In other words, because the rate of egress of air from the cavity 9 during an impact is restricted to the pathways defined by the shell apertures 6, the trapped air acts as an additional cushioning mechanism. The elasticity of the bonding material 8 combined with its relatively large engagement or contact area between the shell 2 and padded membrane 7 by means of the resilient bonding material 8 substantially minimizes the occurrence of padded membrane tearing or ripping. Accordingly, the trampoline-type arrangement of the present invention avoids or minimizes undesirable separation of the shell 2 from the padded membrane 7, leading to appreciably improved pad durability over the prior art.

Figure 3A:
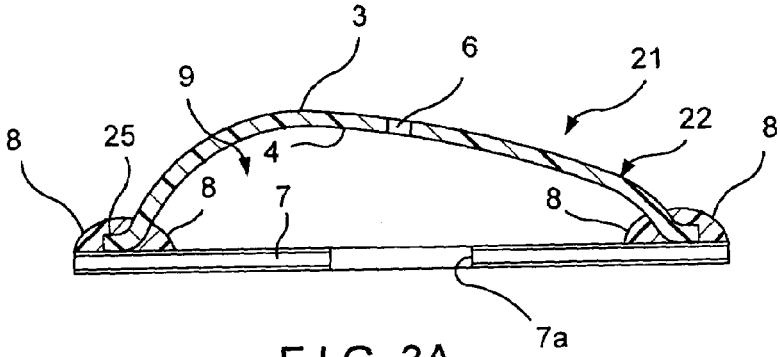
FIG. 3A is a longitudinal cross-sectional view of still another embodiment of the protective pad, with a flange formed along the periphery of the pad body or shell and bonded to the tensioned padded membrane.

Referring briefly to FIG. 3A, in a further aspect of the present invention, a protective pad 21 is provided with a shell 22 having an outwardly-extending perimeter flange 25 contacting the tensioned padded membrane 7. The elastic bonding material 8 preferably covers the extended engagement area of the flange 25 at the exterior of the shell 22, as well as at the inner surface 4 of the shell 22 adjacent to the flange 25. An aperture 7*a* may be provided extending through the padded membrane 7, as heretofore described with respect to the protective pad 11 of FIG. 3.

Figure 4:
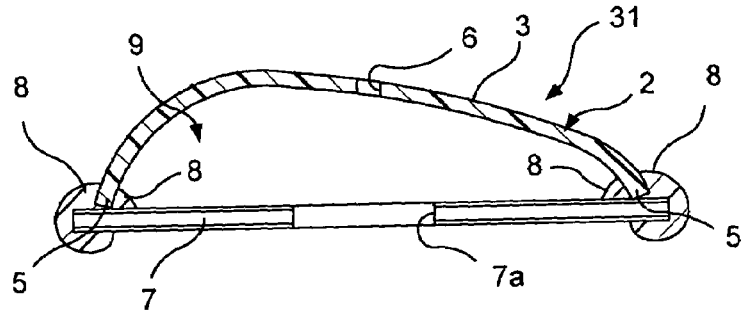
FIG. 4 is a longitudinal sectional view of yet another embodiment of the protective pad, wherein the bonding material extends from the exterior surface of the tensioned padded membrane to an outer area of engagement between the shell and the padded membrane, and is further formed at an inner area of engagement between the tensioned padded membrane and the shell.

Referring briefly to FIG. 4, in another aspect of the present invention, a protective pad 31 is provided having the elastic or resilient bonding material 8 virtually surrounding the area of junction between the shell 22 and the membrane 7. In this manner, the resilient connecting arrangement 8 extends from a lower surface of the stretched padded membrane 7, around a peripheral edge of the padded membrane, to the outer area of engagement between the shell 2 and the padded membrane 7. The elastic suspension arrangement or bonding material 8 is further formed at the inner area of engagement between the shell 2 and the padded membrane 7. An aperture 7*a* is typically provided in the padded membrane 7.

Figure 5:
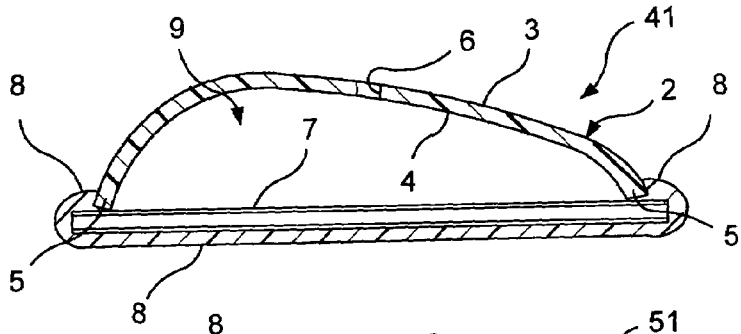
FIG. 5 is a longitudinal sectional view of yet another embodiment of the protective pad wherein the resilient bonding material encapsulates the outer surface of the tensioned padded membrane and extends to the exterior area of engagement between the shell and the tensioned membrane.

Referring briefly to FIG. 5, in yet another aspect of the present invention, a protective pad 41 is provided having a thin layer of the bonding material 8 coating the lower exterior surface of the stretched padded membrane 7 and extending to the exterior area of engagement between the edge 5 of the shell 2 and the padded membrane 7. The thin layer of bonding material 8 on the padded membrane 7 contacts the skin of the user's leg 20 (see FIG. 3) during use and further contributes to the elasticity of the padded membrane 7, absorbing impact energy during use.

Figure 6:
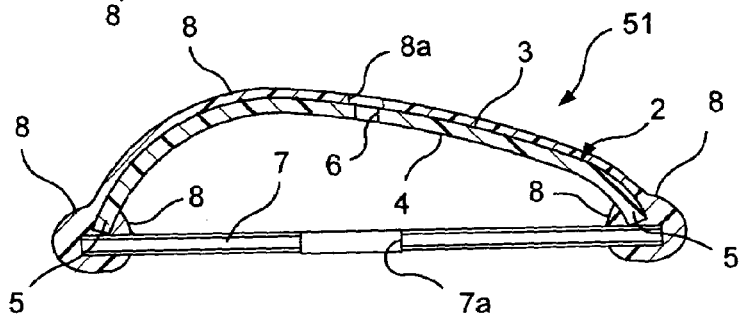
FIG. 6 is a longitudinal sectional view of another embodiment of the protective pad wherein the entire exterior surface of the shell is encapsulated by the elastic bonding material.

Referring briefly to FIG. 6, in still another aspect of the present invention, a protective pad 51 is provided having the bonding material 8 encapsulating the entire convex outer surface 3 of the shell 2. The bonding material 8 further extends along the exterior and interior areas of engagement of the shell 2 with the stretched padded membrane 7, and may further extend around a peripheral edge of the padded membrane 7 to the lower exterior surface thereof. In this manner the elastic or resilient bonding material forms the elastic suspension arrangement which actually surrounds the entire area of junction between the membrane and the shell. An opening 8*a* is preferably provided through the bonding material 8 in communication with, and corresponding to, the air opening 6 of the shell 2.

Figure 7:
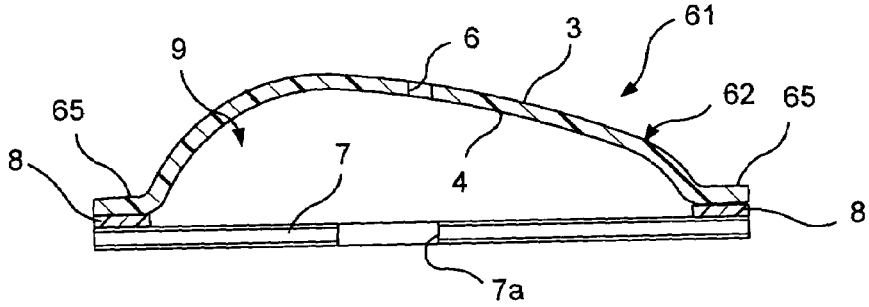
FIG. 7 is a longitudinal sectional view of still another embodiment of the knee pad, wherein the resilient bonding material is disposed between the tensioned membrane and a flange formed along the periphery of the shell.

Referring briefly to FIG. 7, in yet another aspect of the present invention, a protective pad 61 is provided having a shell 62 including an outwardly extending peripheral flange 65. The bonding material 8 is preferably provided disposed between the underside of the flange 65 and the corresponding area of the stretched padded membrane 7. In this manner the elastic suspension arrangement 8 is sandwiched between the flange 65 and the membrane 7.

Figure 7A:
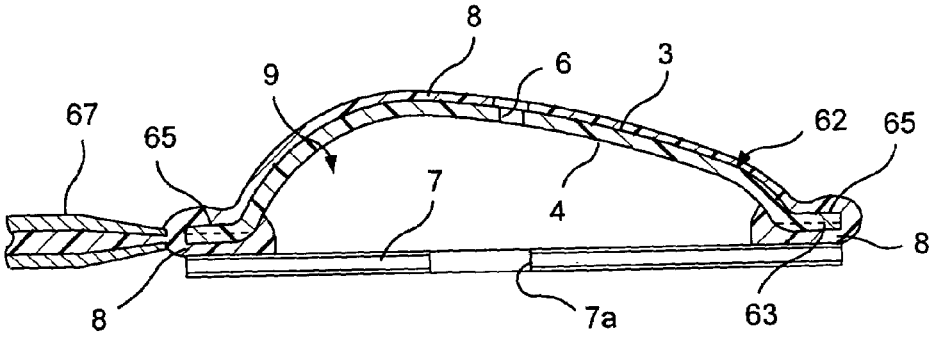
FIG. 7A is a longitudinal sectional view of a still further embodiment of the knee pad, wherein the resilient bonding material is disposed between the tensioned membrane and the flange and further extending to the outer periphery of the shell.

Referring now to FIG. 7A, in still a further aspect of the present invention, a protective pad is formed having a shell 62 with the outwardly extending peripheral flange 65 which is formed with a channel 63 facing the stretched membrane 7 and extending through the length of the flange. During the fabrication the liquefied bonding material 8 is distributed at a high temperature and pressure from a supply mechanism to a molding tip 67 and is initially injected into the channel 63. Upon passing through the length of the flange 65, a barrier or bonding material formation is developed at the interior of the shell in the vicinity of the padded membrane 7. Upon further application of the liquefied bonding material, the flange 65 and the entire shell 62 are spaced from the membrane 7, so that a layer of resilient bonding material 8 is formed therebetween. Upon further application, the bonding material 8 extends around a peripheral edge of the flange 65 to the exterior surface of the shell 62.

Referring now primarily to FIGS. 8A-9F, the protective pad 1 heretofore described with respect to FIGS. 1 and 2 is preferably fabricated in the following manner. As shown in FIGS. 8A and 9A, a sheet of the resilient padded membrane 7, which may be formed having substantially rectangular configuration, is initially attached to the respective padded membrane receiving members or clamps 72 provided at a base 71 of an open injection mold 70. The clamps 72 are typically attached to the outer periphery or the longitudinal and transverse edges of the padded membrane 7. Significantly, in the next operational step, as shown in FIGS. 8B and 9B, to accumulate the required kinetic energy the padded membrane 7 is stretched in multiple directions into a tensioned state or configuration by retracting the fabric clamps 72 outwardly. In this operational step the required kinetic energy is generated and stored within the stretched padded membrane. Alternatively, the resilient padded membrane 7 can be precut and then loaded into the injection mold 70 either manually or automatically. Subsequently, the shell 2 is placed, with its concave surface facing downward, onto the stretched padded membrane 7. After that, as shown in FIGS. 8C and 9C, a bonding mold 73 is positioned over the shell 2. The bonding mold 73 has a concave configuration complementary to the desired configuration of the bonding material 8 to be deposited on the shell 2, as well as concave surfaces or grooves 73*a* extending along the perimeter thereof. A gap 75 is defined between the bonding mold 73 and the shell 2. Multiple bonding material inlet tubes 74 extend through respective openings (not shown) in the bonding mold 73, and communicate with the gap 75. The bonding material inlet tubes 74 are connected to a suitable pump and supply mechanism (not shown) for dispensing the resilient bonding material 8 in a melted, liquid state. Accordingly, the liquefied bonding material 8 is distributed at high heat and pressure from the pump and supply mechanism, through the inlet tubes 74, and injected into the gap 75, wherein the bonding material 8 fills the gap 75 and the spaces defined by the concave surfaces 73*a* extending along the perimeter of the shell 2 retaining its elasticity. As shown in FIGS. 8D and 9D, after the bonding material 8 solidifies, the elastic suspension arrangement is formed, and the bonding mold 73 is lifted from the shell 2. Next, as shown in FIGS. 8E and 9E, a suitable excising device 76 is used to cut the excess padded membrane material 7*b* from the padded membrane 7. In some instances, the excess fabric padded membrane material 7*b* may extend a substantial distance outwardly from the boundaries of the shell 2. In that case, the excess padded membrane material 7*b* may be cut to define straps (not shown) to be used in attachment of the protective pad 1 to the body of a user (not shown), and a hook-and-loop type fastener system, such as VELCRO, may be provided on the straps for attachment purposes. Finally, the fabricated protective pad 1 is removed from the mold 70, as shown in FIGS. 8F and 9F.

In this manner, an engaging surface is defined by a pretensioned padded membrane 7 elastically suspended in a transverse plane from an essentially rigid, or sometimes resilient, outer periphery of the shell 2, with the padded membrane adjoined to the shell by means of the elastic bonding material 8 acting as an elastic suspension arrangement. It will be apparent to those skilled in the art that the fabrication method for the protective pad 1 heretofore described represents only one possible fabrication method and the protective pad 1 may be fabricated according to other techniques.

Referring next to FIGS. 10A-11F, the protective pad 11 heretofore described with respect to FIG. 3 is preferably fabricated in the following manner. As shown in FIGS. 10A and 11A, a sheet of the padded membrane 7, which can be formed having substantially rectangular configuration, is initially attached or clamped to respective receiving members or clamps 82 provided at a base 81 of an injection mold 80. The base 81 includes a base opening 81*a* extending centrally therethrough. The clamps 82 are typically attached to both the longitudinal and transverse edges of the padded membrane 7. Next, as shown in FIGS. 10B and 11B, to accumulate and store the required kinetic energy the padded membrane 7 is stretched in multiple directions, by retracting the fabric clamps 82 outwardly, into a tensioned state or configuration. As shown in FIGS. 10C and 11C, the shell 2 is then placed on the tensioned padded membrane 7, after which a bonding mold 83 is positioned over the shell 2. The bonding mold 83 has a concave configuration which is complementary to the configuration for the bonding material 8 to be deposited on the shell 2. The mold 83 also contains concave surfaces or grooves 83*a* along the perimeter thereof. Multiple exterior bonding material inlet tubes 84 extend through respective openings (not shown) in the bonding mold 83. Furthermore, a pair of interior bonding material inlet tubes 85 extend through the central base opening 81*a* of the base 81. The exterior bonding material inlet tubes 84 and the interior bonding material inlet tubes 85 are connected to a suitable pump and supply mechanism (not shown) for dispending the liquefied bonding material 8. Accordingly, the liquefied bonding material 8 is distributed from the pump and supply mechanism, through the exterior bonding material inlet tubes 84, into the spaces defined by the concave surfaces 83*a*. This occurs in such a manner that the bonding material 8 conforms to the configuration of the concave surfaces 83*a* extending along the outer perimeter of the shell 2 at the junction thereof with the padded membrane 7. The interior bonding material in the tubes 85 are utilized to deliver the liquefied bonding material, so as to form the required bond between the inner perimeter of the shell 2 and the stretched fabric of the padded membrane 7. As shown in FIGS. 10D and 11D, after the bonding material 8 at least partially cures, so as to form the elastic suspension arrangement, the bonding mold 83 is lifted from the shell 2. Next, as shown in FIGS. 10E and 11E, a suitable excising device 76 is used to cut the excess padded membrane material 7*b* from the padded membrane 7. Finally, the fabricated protective pad 11 is removed from the injection mold 80, as shown in FIGS. 10F and 11F. It is understood that the fabrication method for the protective pad 11 heretofore described represents only one possible fabrication method. Thus, the protective pad 11 may be fabricated according to other techniques according to the knowledge of those skilled in the art.

Figure 10G:
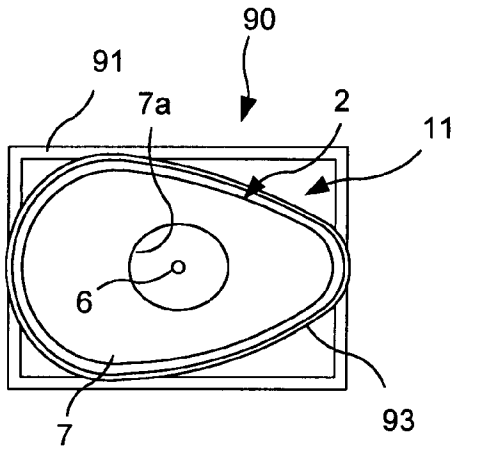
FIG. 10G is a top view of an injection mold, with the protective joint pad of FIGS. 3 and 10F placed in a inverted position in the injection mold.
Figure 10H:
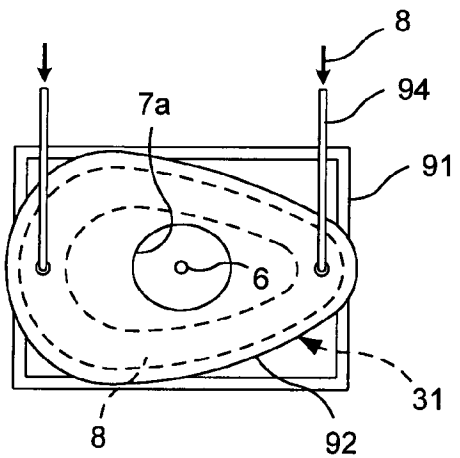
FIG. 10H is a top view of the injection mold of FIG. 10G, illustrating injection molding of the bonding material on the underside of the padded membrane in the regions where the shell contacts the padded membrane.
Figure 10I:
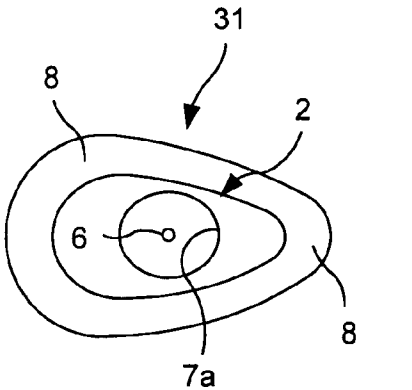
FIG. 10I is a bottom view of the protective joint pad of FIG. 4, fabricated according to the steps of FIGS. 10G and 10H.
Figure 11G:
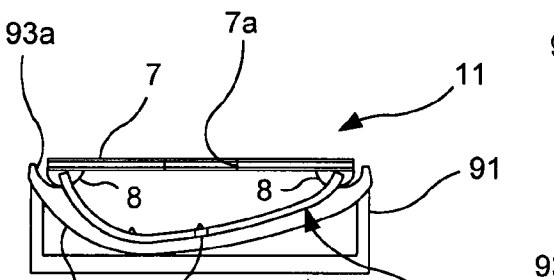
Figure 11H:
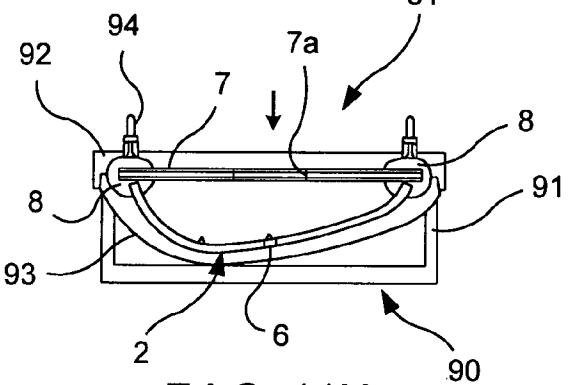
Figure 11I:
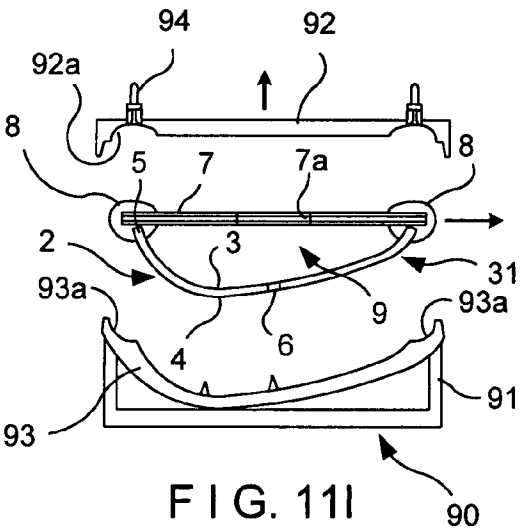
FIG. 11I illustrates removal of the protective joint pad of FIG. 10I from the injection mold.

Referring next to FIGS. 10G-11I, the protective pad 31 heretofore described with respect to FIG. 4 is preferably fabricated in the following manner. As shown in FIGS. 10G and 11G, the protective pad 11 previously fabricated typically according to the steps of FIGS. 10D-11F is placed in an inverted configuration of an injection mold 90. The mold 90 is usually formed having a base 91 that holds a concave bonding mold 93 including a concave surface or groove 93*a* extending around the perimeter thereof. As shown in FIGS. 10H and 11H, a lid 92, having a concave surface or groove 92*a* (FIG. 11I), is then placed over the pad 11. Multiple bonding material inlet tubes 94 extend through respective openings (not shown) in the lid 92, and communicate with the concave surface 92*a*. The bonding material inlet tubes 94 are connected to a suitable pump and supply mechanism (not shown) for the liquefied bonding material 8. Accordingly, the liquefied bonding material 8 is distributed from the pump and supply mechanism, through the inlet tubes 94 and into the space defined by the concave surface 92*a*, wherein the bonding material 8 conforms to the configuration of the concave surface 92*a* of the lid 92 and the concave surfaces 93*a* extending along the perimeter of the bonding mold 93. Thus, the elastic suspension arrangement is formed virtually surrounding the entire area of engagement between the shell and the padded membrane. Finally, as shown in FIGS. 10I and 11I, after the bonding material 8 is at least partially cured, and the elastic suspension arrangement formed, the fabricated protective pad 31 is removed from the bonding mold 93 of the injection mold 90. It is understood that the fabrication method for the protective pad 31 heretofore described represents only one possible fabrication method, and the protective pad 31 may be fabricated according to other techniques according to the knowledge of those skilled in the art.

Figure 12:
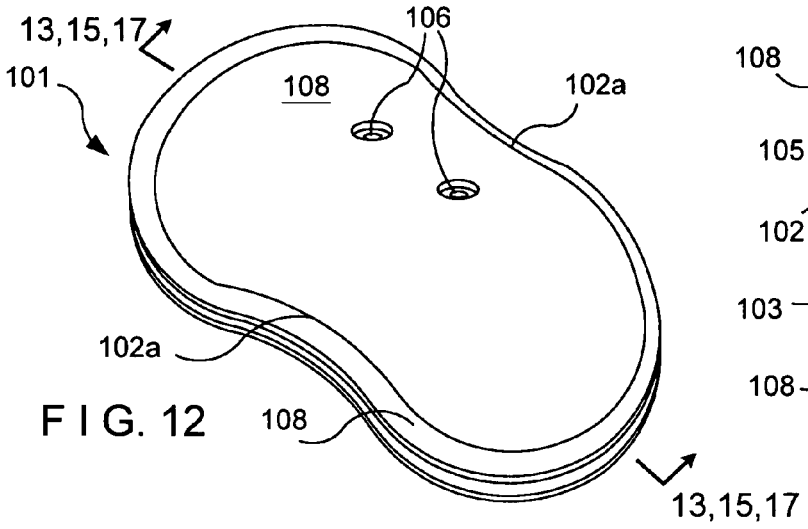
FIG. 12 is a top view of an elbow pad embodiment of the protective pads of the present invention.
Figure 14:
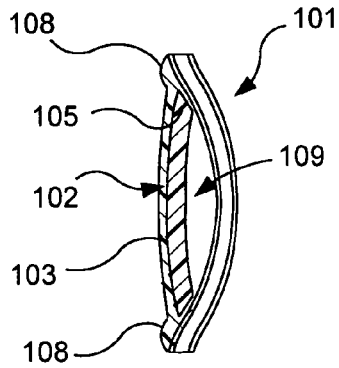
FIG. 14 is a transverse sectional view taken along cutting plane 14-14 in FIG. 13.
Figure 13:
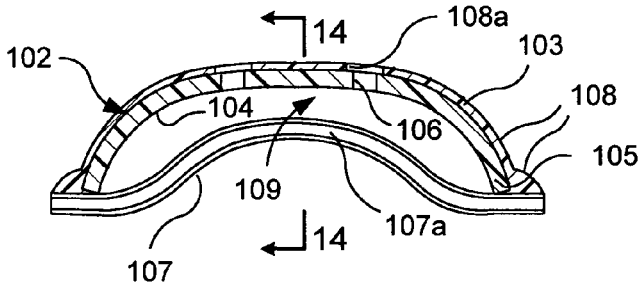
FIG. 13 is a longitudinal sectional view taken along cutting plane 13-13 in FIG. 12.

Referring now to FIGS. 12-14, illustrating an elbow protective pad 101 fabricated according to the principles of the invention. The elbow pad 101 includes an elongated, semi-rigid, generally elliptical pad body or shell 102. The outer periphery of the shell 102 may generally define the shape of the numeral "8" when viewed from the front, as shown in FIG. 12, and includes concave side edges 102*a*. As further shown in FIG. 13, the shell 102 has a convex outer surface 103, a concave inner surface 104 and a continuous edge 105. Preferably, one or more vent openings 106 are provided extending through the shell 102. During the manufactured process a resilient padded membrane 107, fabricated from a resilient material such as neoprene, prior to being connected to the shell 102 is stretched in multiple directions, so as to be placed into a pre-tensioned state or configuration. After that it is bonded to the edge 105 at the outer area of engagement of the shell 102. In this manner the elastic suspension arrangement is formed using an elastic or resilient bonding material 108 such as previously described with respect to prior embodiments of the invention. The elastic or resilient bonding material 108 preferably may extend to or cover a substantial portion or the entire outer surface 103 of the shell 102, as shown in FIG. 13. However, it should be noted that the bond between the shell 102 and the padded membrane 107 can be also formed in a manner previously described with respect to the embodiments of FIGS. 3, 3*a*, 4, 5, 6 and 7. An air-containing cavity 109 is defined between the shell 102 and the tensioned padded membrane 107. When viewed in longitudinal cross-section, as shown in FIG. 13, the tensioned padded membrane 107 typically protrudes into the cavity 109 in the center region of the protective pad 101 at a protrusion 107*a*. In use, the protective pad 101 is strapped to the user's arm (not shown) using straps (not shown), for example, with the user's elbow contacting the padded membrane 107. During the force of an impact, the shell 102, tensioned padded membrane 107, the elastic suspension arrangement utilizing resilient boding material and air-filled cavity 109 absorb the impact energy in the same manner as previously described with respect to the knee pad embodiment of FIGS. 1-7.

Figure 16:
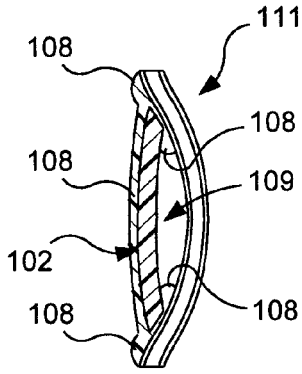
FIG. 16 is a transverse sectional taken along cutting plane 16-16 in FIG. 15.
Figure 15:
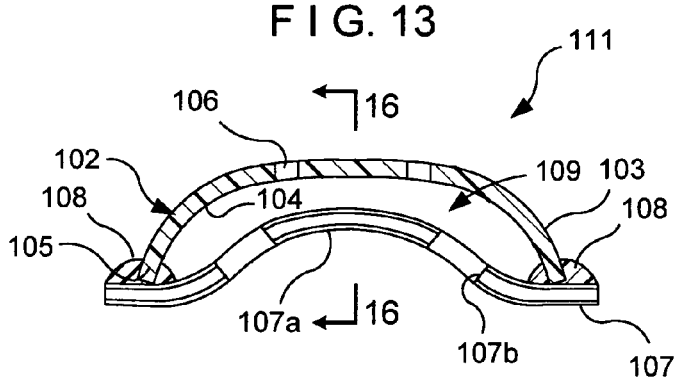
FIG. 15 is a longitudinal sectional view taken along cutting plane 15-15 in FIG. 12.

Referring now to FIGS. 12, 15 and 16, in another aspect of the present invention, a protective elbow elastic pad, indicated generally by reference numeral 111, includes bonding material 108 forming the suspension arrangement provided along both the outer and inner areas of engagement of the shell 102 with the tensioned padded membrane 107. One or more apertures 107*b* are preferably provided extending through the tensioned padded membrane 107.

Figure 18:
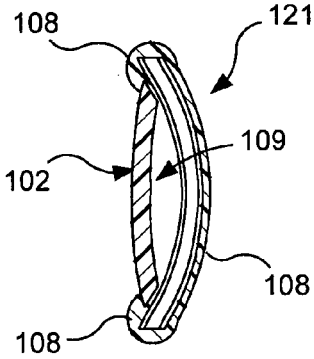
FIG. 18 is a transverse sectional view taken along cutting plane 18-18 in FIG. 17.
Figure 17:
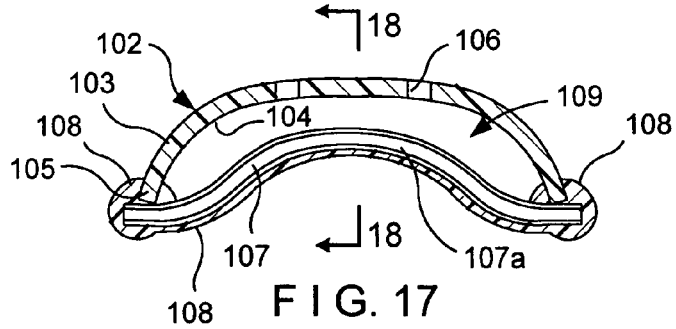
FIG. 17 is a longitudinal sectional view taken along cutting plane 17-17 in FIG. 12.
Figure 19:
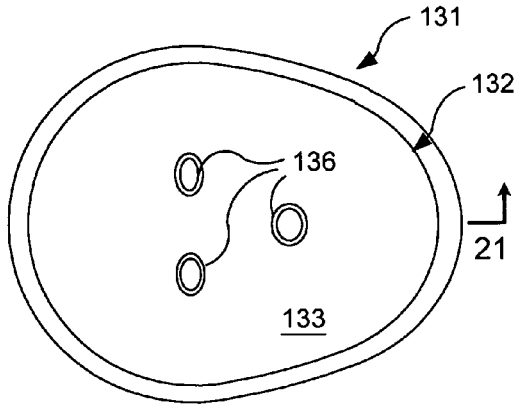
FIG. 19 is a top view of a protective helmet embodiment of the present invention.
Figure 20:
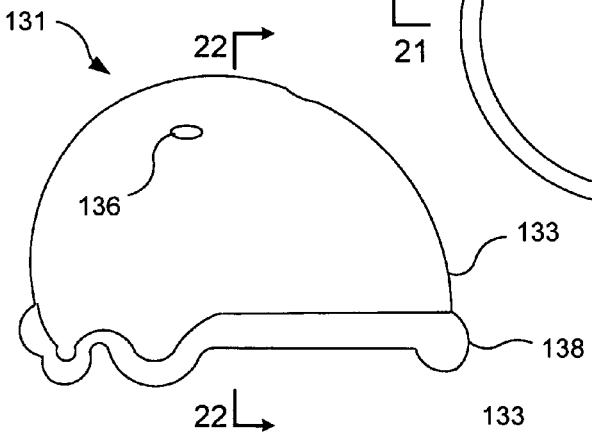
FIG. 20 is a side view of the protective helmet embodiment shown in FIG. 19.

Referring now to FIGS. 12, 17 and 18, in yet another elbow pad embodiment of the protective pads, indicated by reference numeral 121, the bonding material 108 forming the elastic suspension arrangement is provided along both the inner and outer areas of engagement of the shell 102 with the padded membrane 107, and also extending to or covering the exterior surface of the padded membrane 107 with a layer of the bonding material 108. Accordingly, the layer of the elastic bonding material 108 of the suspension arrangement, in addition to the resilient padded membrane 107, the shell 102 and the air contained in the cavity 109, absorbs impact energy upon striking of an object or person against the shell 102.

Figure 21:
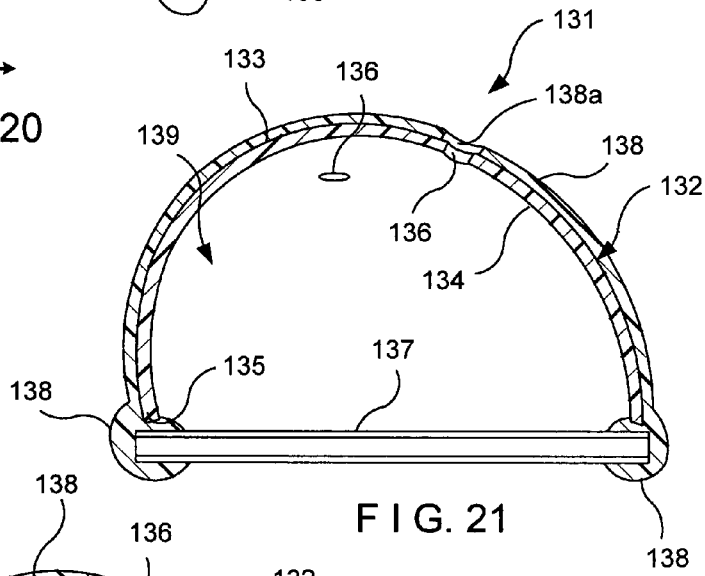
FIG. 21 is a longitudinal sectional view taken along cutting plane 21-21 in FIG. 19 and showing the protective helmet prior to being positioned on a head of a user.
Figure 22:
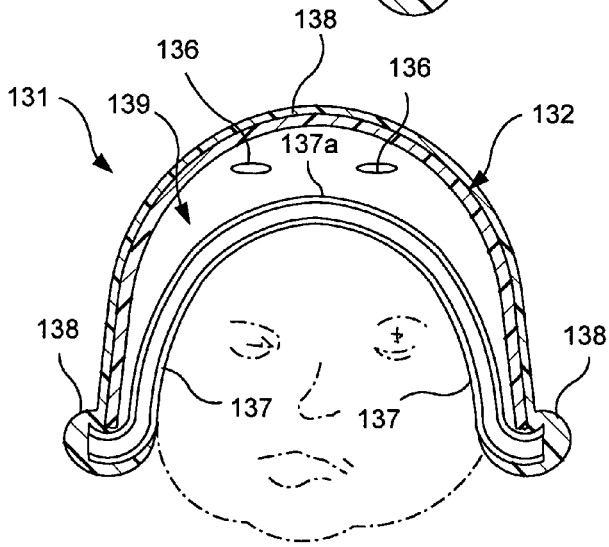
FIG. 22 is a transverse sectional view taken along cutting plane 22-22 in FIG. 20 and showing the helmet being positioned on the head of the user.

Referring now to FIGS. 19-22, in another embodiment of the present invention, a protective helmet 131 is provided having a generally semi-spherical, semi-rigid shell 132. The shell 132 includes a convex outer surface 133 and a concave inner surface 134 adjoined by a continuous edge 135, as shown in FIG. 21. One or more vent openings 136 preferably extend through the shell 132. An elastic bonding material 138 is provided along the areas of engagement of the shell 132 with a pre-tensioned resilient padded membrane 137 forming an elastic or resilient suspension arrangement. As illustrated in FIG. 21, the resilient padded membrane is stretched into a tensioned state prior to having the shell 132 bonded thereto. During the tensioning process, the padded membrane 137 stores kinetic energy that tends to return it to the initial unstressed condition. The bonding material 108 may extend or cover the convex outer surface 133 of the shell 132, as best shown in FIG. 21. A cavity 139 is defined between the tensioned padded membrane 137 and the shell 132. Preferably, one or more vent openings 138*a* are provided extending through the resilient bonding material 138 in communication with the corresponding vent openings 136 extending through the shell 132. As illustrated in FIG. 22, upon being positioned on the head of a user the tensioned padded membrane 137 forms a concave middle portion 137*a*. Thus, upon application of a force against the exterior of the helmet 131, the resilient padded membrane 137 overlying the head of a user temporarily stretches or flexes into the inner cavity 139. In this manner, the impact energy of force against the shell 132 is transferred to and absorbed by the elasticity of the suspension arrangement including the bonding material 138 and the resiliency of the padded membrane 137. The protective helmet 131 is preferably fastened to the user's head using conventional straps (not shown).

Figure 23:
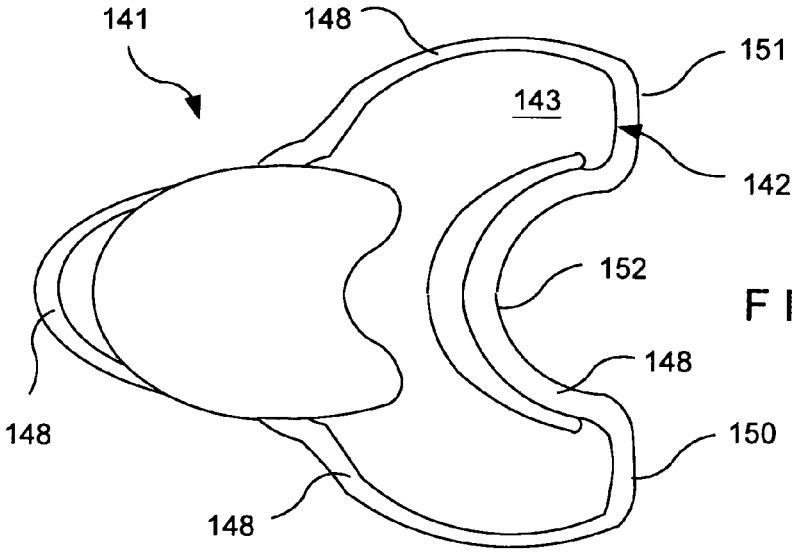
FIG. 23 is a top view of a shoulder pad embodiment of the protective pads of the present invention.
Figure 24:
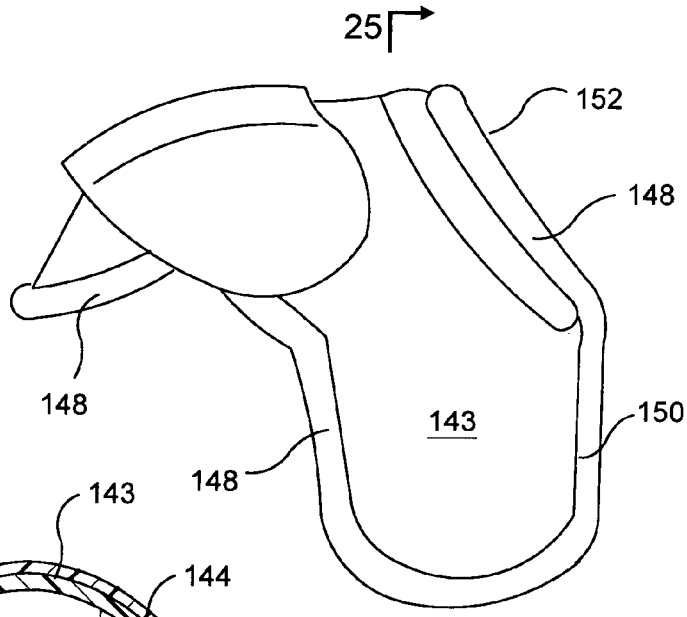
FIG. 24 is a front view of the shoulder pad embodiment of the protective pad shown in FIG. 23.
Figure 25:
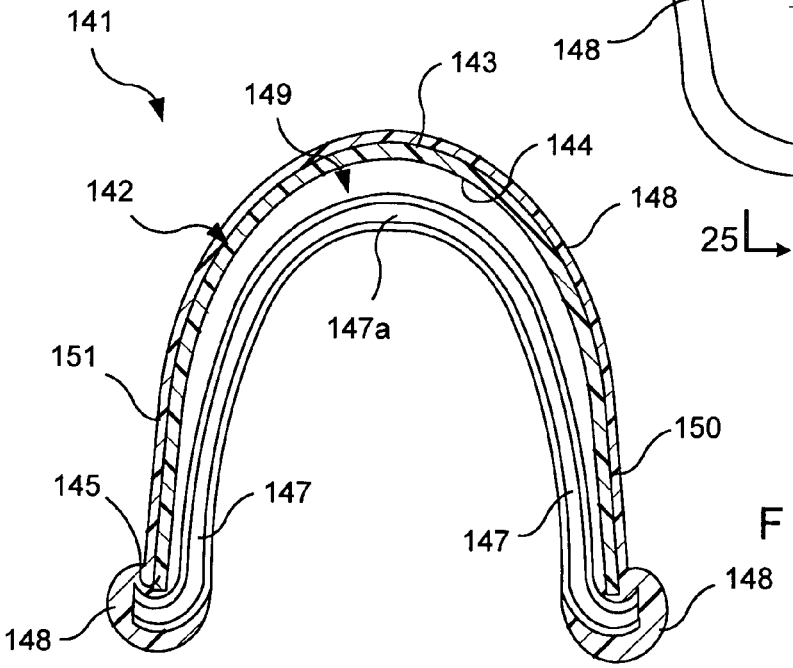
FIG. 25 is a transverse sectional view taken along cutting plane 25-25 in FIG. 24.

Referring now to FIGS. 23-25, in yet another embodiment of the present invention, a shoulder pad 141 is provided having a semi-rigid pad body or shell 142 including a convex outer surface 143 and a concave inner surface 144 adjoined by a continuous edge 145, as shown in FIG. 25. The shell 142 further includes a chest cover portion 150 which, in use, extends over a portion of the chest (not shown) of a wearer, and back cover portion 151 which extends over a portion of the back (not shown) of the wearer. A neck notch 152 defined between the chest cover portion 150 and the back cover portion 151 is configured for receiving the neck (not shown) of the wearer. The elastic suspension arrangement including the resilient bonding material 148 suspends a pre-tensioned resilient padded membrane 147 within the shell 142, and preferably covers the exterior areas of engagement of the padded membrane 147 with the shell 142, as well as the convex outer surface 143 of the shell 142. The pre-tensioned padded membrane 147 preferably includes a concave portion 147*a* that extends into the curvature defined by the concave shell 142. The elastic bonding material 148 may further extend partially along the outer surface of the tensioned padded membrane 147, as further shown in FIG. 25. A cavity 149 is defined between the pre-tensioned padded membrane 147 and the concave inner surface 144 of the shell 142. The protective pad 141 is shown configured to be worn on the right shoulder of a wearer. Accordingly, a protective pad (not shown) designed to be worn on the left shoulder of the wearer would be substantially identical in design to the protective pad 141 shown in FIGS. 23-25, but would comprise a mirror image of the protective pad 141.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A protective pad comprising:

a shell having a concave interior surface and a convex outer surface adjoined by a perimeter edge;

a pre-tensioned resilient padded membrane; and an elastic suspension arrangement adjoining said pretensioned resilient padded membrane about the perimeter edge of said shell to define a cavity between said shell and said pre-tensioned resilient padded membrane;

wherein said pre-tensioned resilient padded membrane being stretched in multiple directions prior to being elastically suspended at said shell, and said elastic suspension arrangement further comprising a resilient bonding material, so that a trampoline-type unit is formed by said shell, pre-tensioned resilient padded membrane and elastic suspension arrangement.

2. A protective pad as recited in claim 1, wherein said resilient bonding material is provided at an outer area of engagement between said shell and said pre-tensioned resilient padded membrane.

3. A protective pad as recited in claim 1, wherein said resilient bonding material extends to or substantially covers an exterior of said shell.

4. A protective pad as recited in claim 3, wherein said resilient bonding material is provided at an outer area of engagement of said shell with said pre-tensioned resilient padded membrane.

5. A protective pad as recited in claim 1, wherein said resilient bonding material extends to or substantially covers said tensioned resilient padded membrane.

6. A protective pad as recited in claim 5, wherein said resilient bonding material is provided at an outer area of engagement of said shell with said pre-tensioned resilient padded membrane.

7. A protective pad as recited in claim 2, wherein said resilient bonding material is provided at an inner area of engagement of said shell with said pre-tensioned resilient padded membrane.

8. A protective pad as recited in claim 7, wherein said resilient bonding material extends to an exterior of said shell.

9. A protective pad as recited in claim 1, wherein said shell further comprising an integral shell flange outwardly extending from an outer periphery thereof and configured for engaging said resilient bonding material.

10. A protective pad as recited in claim 9, wherein said resilient bonding material is provided at inner and outer areas of engagement of said flange with said tensioned resilient padded membrane.

11. A protective pad as recited in claim 9, wherein said resilient bonding material is sandwiched between said flange and said pre-tensioned resilient padded membrane.

12. A protective pad as recited in claim 7, wherein the resilient bonding material provided at said outer area of engagement of said shell and said padded membrane extends completely around an edge of said pre-tensioned resilient padded membrane.

13. A protective pad as recited in claim 7, wherein said padded membrane has an opening extending therethrough and configured for engaging a human joint.

14. A pad for protecting a joint of a human limb, comprising:

a shell having a convex outer surface, a concave inner surface having a contour complementing the joint of said human limb, and an outer edge adjoining said inner and outer surfaces;

a pre-tensioned resilient padded membrane; and an elastic suspension arrangement adjoining said pretensioned resilient padded membrane about the edge of said shell to define a cavity between said shell and said pre-tensioned resilient padded membrane;

wherein a said tensioned resilient padded membrane being stretched in multiple directions prior to being suspended at said shell, said elastic suspension arrangement further comprises a resilient bonding material, so that a trampoline-type unit is formed by said shell, pre-tensioned resilient padded membrane and elastic suspension arrangement.

15. A joint pad as recited in claim 14, wherein said resilient bonding material is provided at an outer area of engagement of said shell with said pre-tensioned resilient padded membrane.

16. A joint pad as recited in claim 14, wherein said resilient bonding material is provided at an inner area of engagement of said shell with said pre-tensioned resilient padded membrane.

17. A joint pad as recited in claim 16, wherein said resilient bonding material is provided at an outer area of engagement of said shell with said pre-tensioned resilient padded membrane.

18. A joint pad as recited in claim 15, wherein said resilient bonding material extends to the convex outer surface of said shell.

19. A joint pad as recited in claim 17, wherein said resilient bonding material extends to or covers the convex outer surface of said shell.

20. A joint pad as recited in claim 17, wherein said resilient bonding material substantially covers said tensioned resilient padded membrane.

* * * * *